US005102343A

United States Patent [19]

Knight et al.

[11] Patent Number: 5,102,343

[45] Date of Patent: Apr. 7, 1992

[54] FLUID PRESSURE ACTUATED ELECTRICAL CONNECTOR

[75] Inventors: Alan D. Knight, Newark Valley; James R. Petrozello, Endicott, both of N.Y.

[73] Assignee: International Business Machines Corporation, Armonk, N.Y.

[21] Appl. No.: 658,941

[22] Filed: Feb. 22, 1991

[51] Int. Cl.[5] ..... H01R 9/09; H01R 13/40

[52] U.S. Cl. ..... 439/67; 439/77; 439/197; 439/493; 439/591

[58] Field of Search ..... 439/66, 67, 74, 77, 439/91, 197, 493, 591

[56] References Cited

U.S. PATENT DOCUMENTS

| | | | |
|---|---|---|---|
| 2,956,258 | 10/1960 | Raddin | 439/197 |
| 2,978,666 | 4/1961 | McGregor | 439/197 |
| 3,076,166 | 1/1963 | Raddin | 439/197 |
| 3,090,026 | 5/1963 | Raddin | 439/197 |
| 3,366,916 | 1/1968 | Oktay | 439/197 |
| 3,553,021 | 1/1971 | Eberle | 136/82 |
| 3,594,707 | 7/1971 | Peterson | 439/197 |
| 3,596,228 | 7/1971 | Reed et al. | 439/197 |
| 3,796,986 | 3/1974 | Tamburro | 339/92 M |
| 3,960,424 | 6/1976 | Weisenburger | 339/17 M |
| 4,220,389 | 9/1980 | Schell | 339/74 |
| 4,232,928 | 11/1980 | Wickersham | 339/117 P |
| 4,295,700 | 10/1981 | Sado | 339/17 M |
| 4,427,250 | 1/1984 | Hines et al. | 339/117 P |
| 4,428,640 | 1/1984 | Pittman | 339/17 LC |
| 4,629,270 | 12/1986 | Andrews et al. | 339/75 MP |
| 4,636,018 | 1/1987 | Stillie | 339/17 M |
| 4,649,339 | 3/1987 | Grangroth et al. | 324/158 F |
| 4,688,151 | 8/1987 | Kraus et al. | 439/68 |
| 4,738,637 | 4/1988 | Asick et al. | 439/610 |
| 4,793,814 | 12/1988 | Zifcak et al. | 439/66 |
| 4,863,395 | 9/1989 | Babuka et al. | 439/260 |
| 4,886,461 | 12/1989 | Smith | 439/67 |
| 4,911,643 | 3/1990 | Perry et al. | 439/67 |
| 4,912,772 | 3/1990 | Beaudry et al. | 439/79 |
| 4,943,242 | 7/1990 | Frankeny et al. | 439/65 |
| 4,968,265 | 11/1990 | Fox, Jr. | 439/197 |
| 5,007,842 | 4/1991 | Deak et al. | 439/77 |
| 5,026,290 | 6/1991 | Dery | 439/67 |
| 5,071,357 | 12/1991 | Van Brunt, Jr. et al. | 439/197 |

FOREIGN PATENT DOCUMENTS

| | | | |
|---|---|---|---|
| 3621064 | 1/1988 | Fed. Rep. of Germany | 439/197 |
| 2495390 | 11/1980 | France . | |
| 1598308 | 9/1981 | United Kingdom | 439/197 |

OTHER PUBLICATIONS

IBM TDB vol. 13, No. 9, Feb., 1971, "High Capacity Electrical Connector", p. 2707, by M. L. Brain et al.

IBM TDB vol. 12, No. 9, Feb., 1970, "Zero Insertion Force Pin-To-Pin Connector", pp. 1325-1326, by K. E. Burbank.

IBM TDB vol. 12, No. 11, Apr., 1970, "Electrical Connector With Can Action", pp. 1741-1742 by T. Kehagioglou.

IBM TDB vol. 13, No. 11, Apr., 1971, "Pneumatic Contactor", p. 3567, by M. L. Brain.

IBM TDB vol. 14, No. 10, Mar., 1972, "Fluidic Connector", p. 2916, by T. Welnicki.

IBM TDB vol. 20, No. 3, Aug., 1977, "Zero Insertion Force Pneumatic Pin-To-Pin Connector", by Buyck et al., pp. 977-978.

IBM TDB vol. 31, No. 3, Aug., 1988, "Curved Zero Insertion Force Socket With Hydraulic Actuation", pp. 485-486, by Dickerson et al.

IBM TDB vol. 8, No. 4, Sep., 1965, "Transmission Line Connector", pp. 518-519, by Stuckert.

*Primary Examiner*—Paula A. Bradley

*Attorney, Agent, or Firm*—Lawrence R. Fraley

[57] ABSTRACT

An electrical connector which utilizes fluid pressure to interconnect two electrical circuit members (e.g., a circuit module and a printed circuit board) in a sound and effective manner. In one embodiment, two flexible circuits are brought together using two expandable bladders which are located within a housing located between the circuit members. When expanded, the bladders engage the flexible circuits and cause these to move toward each other such that arrays of contacts become engaged. In another embodiment, a singular flexible circuit and operatively connected bladder are used such that expansion of the bladder causes separate arrays of contacts on the flexible circuit to move toward and engage respective circuitry on the circuit members.

32 Claims, 4 Drawing Sheets

FLUID PRESSURE ACTUATED ELECTRICAL CONNECTOR

TECHNICAL FIELD

The invention relates to the field of electrical connectors for electrically interconnecting at least two electrical circuit members such as circuit modules and printed circuit boards. More particularly, the invention relates to such connectors wherein fluid pressure actuation is utilized. Even more particularly, the invention relates to such connectors which may be utilized in the information handling systems (computer) environment.

CROSS REFERENCE TO COPENDING APPLICATIONS

In Ser. No. 07/427,548, filed Oct. 27, 1989, there is defined an elastomeric interposer member for interconnecting circuit embers wherein differential stress is reduced in the elastomer body, thus assuring enhanced connection reliability.

In Ser. No. 07/415,435, filed Sept. 28, 1989, there is defined a type of electrical connection wherein a plurality of interdigitated members (e.g., those of the dendritic variety) are utilized, the materials for such members possibly comprised of palladium, platinum, rhodium, ruthenium, osmium and tungsten. Dendritic, interdigitated members such as these may be used as the contacts in the present invention.

In Ser. No. 07/510,907, filed Apr. 18, 1990, there is defined a fluid pressure actuated connector for electrically connecting a pair of flexible circuits having a plurality of contact pads thereon. This application also defines using such fluid pressure to connect two flexible circuits to the circuitry on an interim circuit member (e.g., printed circuit board).

In Ser. No. 07/628,057, filed Dec. 17, 1990 (entitled "High Density Connector", inventors F. W. Chapin et al, attorney's docket number EN990072), there is defined an electrical connector for interconnecting two circuit members (e.g., a circuit module and a printed circuit board) wherein a plurality of resilient contact springs are used within an insulative frame, in combination with a plurality of resilient retention rods (to hold the contacts in place). This application also defines such a connector wherein an elastomeric structure having individual contacts (including metallic fibers therein) as part thereof may be utilized.

All of the above identified applications are assigned to the same assignee as the present invention.

BACKGROUND OF THE INVENTION

Utilization of fluid pressure means in the field of electrical connectors is known, with various examples of such connectors illustrated and described in U.S. Pat. Nos. 2,956,258, 2,978,666, 3,076,166, 3,090,026, 3,366,916, 3,553,021, 3,594,707, 4,220,389, 4,232,928, 4,427,250 and 4,649,339. Typically, some type of inflatable member or the like is coupled to a suitable fluid source (hydraulic or pneumatic) which provides the needed fluid to actuate the inflatable member and cause the desired connections. Understandably, by the term fluid as used in these patents, as well as in the present specification, is meant to include both liquid and gas applications. The advantages of using such fluid pressure actuation are well known, including, particularly, uniformity of force application against the respective circuit or contact members, ease of actuation, and relatively high contact forces (if desired).

Various types of electrical interconnectors are also known in the art, including, for example, those described and illustrated in U.S. Pat. Nos. 3,796,986, 3,969,424, 4,295,700, 4,636,018, 4,688,151, 4,738,637, 4,793,814, 4,912,772 and 4,943,242. Typically, however, such connectors of the known prior art fail to provide for high density interconnections in a sound and reliable manner, as is of course essential in the highly sophisticated information handling system field. Such connectors also typically fail to provide repeatability of connection (wherein the connector may be readily removed, and replaced and/or re-positioned, e.g., in times of repair). Such interconnectors have also, typically, been of relatively complex design and thus relatively difficult to assemble. The above disadvantages are considered particularly onerous when attempting to interconnect two separate circuit members such as a printed circuit board and a circuit module.

As will be defined herein, the connector of the instant invention utilizes fluid pressure actuation and the several distinct advantages thereof. In addition, the connector of the invention assures high density interconnection in a sound and effective manner, while assuring separability of connection (e.g, when repair and/or replacement is needed, as well as when testing is desired). Significantly, the invention is able to accomplish this with a relatively simple design which can thus be assembled and operated in a relatively facile manner.

It is believed that such an interconnector will constitute a significant advancement in the art.

DISCLOSURE OF THE INVENTION

It is, therefore, a primary object of this invention to enhance the art of electrical connectors by providing an electrical connector for interconnecting a pair of circuit members wherein fluid pressure actuation (and the several advantages thereof) is utilized.

It is another object of the invention to provide an electrical connector of the above type which assures sound and effective connections between high density arrays of electrical contacts.

It is still another object of the invention to provide such a connector which is of relatively simple construction and which can be assembled and operated in a relatively facile manner.

In accordance with one embodiment of the invention, there is provided an electrical connector for interconnecting first and second electrical circuit members wherein the connector includes a housing for being located between the two circuit members, first and second flexible circuits each including an array of contacts thereon and adapted for being electrically coupled to the first and second circuit members, respectively, first and second expandable bladders located substantially within the housing for exerting force against the first and second flexible circuits, respectively, to cause the contact arrays thereon to become engaged, and fluid pressure means operatively connected to the bladders for causing expansion thereof such that the defined contact engagement will occur.

In accordance with another embodiment of the invention, there is provided an electrical connector for interconnecting first and second electrical circuit members wherein the connector comprises a housing for being positioned between the two circuit members, a flexible circuit located substantially within the housing and having two arrays of contacts thereon which are each adapted for being electrically coupled to a respective one of the circuit members, an expandable bladder also located substantially within the housing for exerting force against the contact arrays to cause the arrays to move toward the respective circuit members and effect said engagement, and fluid pressure means operatively coupled to the bladder for expanding the bladder to effect said array movement and engagement.

BEST MODE FOR CARRYING OUT THE INVENTION

For a better understanding of the present invention, together with other objects, advantages and capabilities thereof, reference is made to the following disclosure in combination with the above-described drawings.

Figure 1:
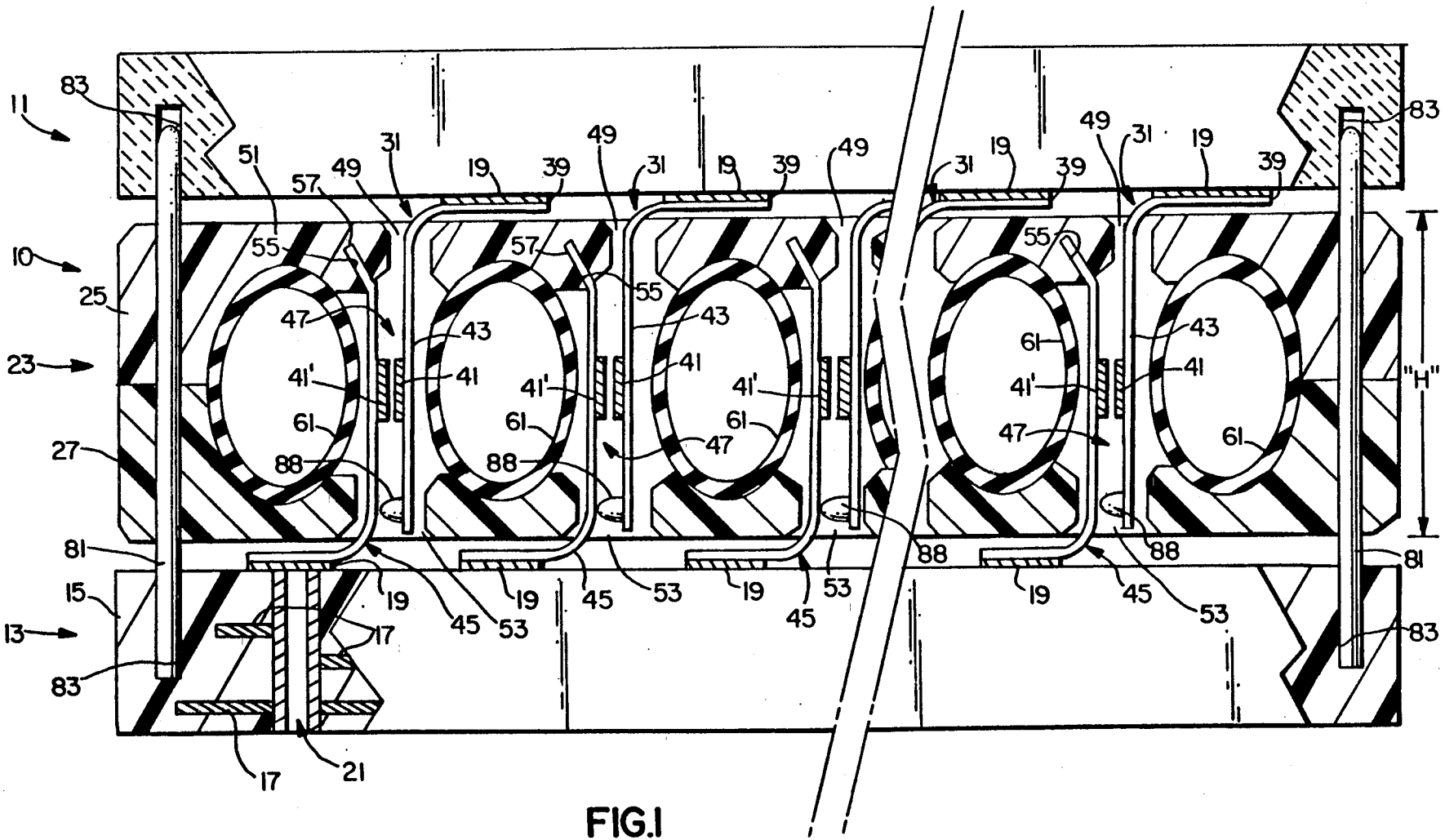
FIG. 1 is a partial, side elevational view, partly in section, of an electrical connector in accordance with one embodiment of the invention, prior to actuation thereof.

In FIG. 1, there is shown an electrical connector 10 in accordance with one embodiment of the invention. Connector 10 is designed for electrically interconnecting first and second electrical circuit members 11 and 13. Examples of such circuit members include circuit modules and printed circuit boards. By the term circuit module is meant to include a substrate or the like member having various electrical components (e.g., semiconductor chips, conductive circuitry, conductive pins, etc.) which may form part thereof. Representative examples are shown and described in U.S. Pat. Nos. 4,688,151 and 4,912,772. Further description is thus not believed necessary and the disclosures of these patents are thus incorporated herein by reference. By the term printed circuit board is meant to define a substrate including therein at least one (and, typically, several) conductive layer which in turn may provide signal, power and/or ground functions. Representative examples are shown and defined in U.S. Pat. Nos. 3,969,177, 4,515,578, 4,521,280, 4,554,405, 4,662,963, 4,700,016, 4,705,592 and 4,916,260, all of which are assigned to the assignee of the present invention. Typically, such printed circuit boards (a/k/a printed wiring boards) as used in computer products include a plurality of signal planes in combination with associated power planes located at different, designated levels within the composite structure depending on the product's operational requirements.

In FIG. 1, circuit member 11 is illustrated as a circuit module, whereas circuit member 13 is represented as a printed circuit board. This is not meant to limit the invention, however, as other circuit member combinations are readily possible. Circuit member 13, being a printed circuit board, is shown to include the aforementioned dielectric substrate 15 having therein a plurality of conductive planes (layers) 17 which function as defined above (signal, ground, and/or power).

Significantly, connector 10 is capable of providing connections between high density arrays of electrical contact segments 19 which are formed on the facing external surfaces of members 11 and 13, respectively. By the term high density as used herein, including to define the arrays of contacts for connector 10, is meant to define electrical contact pads of a sound conductive material such as copper which are of small overall size, such pads being located in close proximity to one another in accordance with a predetermined pattern. These may also include an overplate (e.g., nickel) and a precious metal (e.g., gold) thereon. As an illustrated example, such segments (or pads) 19 may possess a rectangular configuration with a height (thickness) of only about 0.001 to about 0.002 inch, with side dimensions of only about 0.020 inch by about 0.020 inch. Such contact segments, obviously enlarged substantially in the view of FIG. 1, may be of even smaller dimensions (e.g., about 0.012 by about 0.012 inch side dimensions). Center-to-center spacings for such contacts may be only about 0.025 inch. Accordingly, a total of about 1,600 contact segments 19 may be located on approximately one square inch of circuit member surface.

The above dimensions are, of course, not meant to limit the invention, in that connector 10 is readily capable of providing sound, effective interconnections between contact segments 19 of substantially larger configuration, particularly when connector 10 is to serve as a power connector. Such contacts, if used in this capacity, may possess a height of about 0.001 inch to about 0.003 inch with corresponding side dimensions of about 0.040 inch and 0.040 inch, respectively. These contacts, being rectangular, are preferably spaced apart at approximately 0.050 inch center-to-center dimensions.

Understandably, each contact segment 19 may in turn be electrically connected to internal circuitry and/or components within the circuit member's substrate. By way of example, the contact segment 19 of circuit member 15 as illustrated to the far left in FIG. 1 is shown as being electrically coupled to selective ones of the internal conductive layers 17 through a conductive aperture (a/k/a a plated through hole) 21. Additionally, contact segments 19 may also be electrically connected to external circuitry located on the respective facing surfaces occupied by these segments. Such circuitry is not shown, for illustration purposes.

Figure 6:
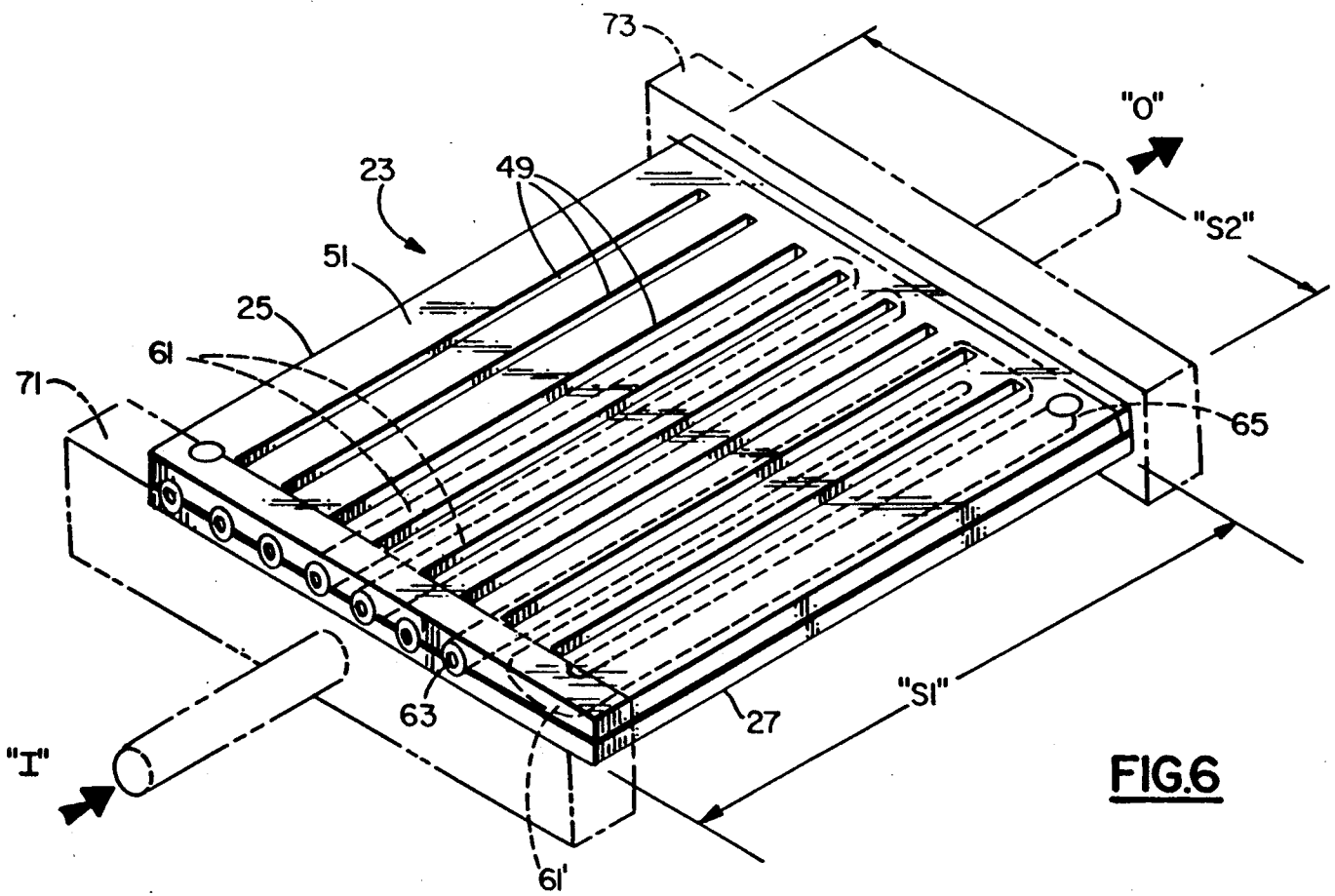
FIG. 6 is a perspective view, on a reduced scale over the view in FIG. 1, of the housing of FIG. 1, illustrating the various expandable bladders as might be used therein to accomplish the high density connections of the instant invention and the manifold structures suitable for use therewith.

Connector 10 includes a housing 23 adapted for being positioned substantially between circuit members 11 and 13. Housing 23 is preferably of electrically insulative material, e.g., plastic, with suitable examples being polyphenylene sulfide and polyphenylene oxide. Further, housing 23 is preferably of two-part construction, including an upper part 25 and lower part 27, (the latter designed for aligning with and securing to the upper part to facilitate assembly of the invention). In one example of the invention, housing 23 preferably possesses an overall height (thickness) of about 0.200 inch, said height dimension represented by the letter "H" in FIG. 1. Housing 23, as further illustrated in FIG. 6, is also preferably of rectangular configuration with side dimensions ("S1", "S2") of about 5.0 inch and about 5.0 inch, respectively. Housing 23 is thus preferably of substantially rectangular, box-like configuration with substantially planar upper and lower external surfaces for respectively aligning with the facing, external surfaces of circuit members 11 and 13.

Figure 2:
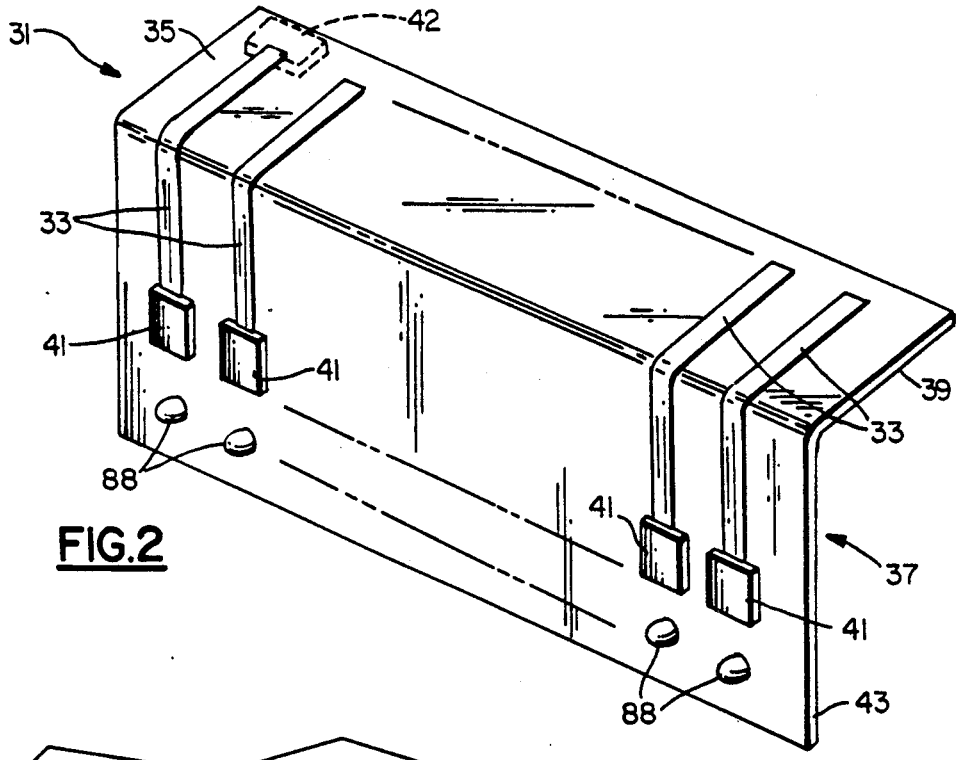
FIG. 2 is an enlarged view, in perspective, of one of the flexible circuits that may be used in the invention.

In order to accomplish electrical interconnection between members 11 and 13, connector 10 utilizes a plurality of flexible circuits 31 and 45. Flexible circuits are known in the art and typically include a thin dielectric (e.g., polyimide) substrate of relatively thin (e.g., from about 0.002 to about 0.005 inch thickness) construction with conductive circuitry on at least one (and possibly two) surfaces thereof. In the invention, one example of such a flexible circuit is depicted in FIG. 2, this circuit represented by the numeral 31. Flexible circuit 31, as shown in FIG. 2, includes the aforementioned conductive circuitry 33 (represented by individual conductive lines) formed on the outer surface 35 of dielectric substrate 37. In FIG. 1, a plurality of flexible circuits 31, referred to hereinafter as first flexible circuits, are shown, each adapted for being electrically coupled to respective arrays of contact segments 19 on module 11. That is, each of the conductive lines of circuitry 33 is adapted for being electrically connected to a respective one (or more, if desired) of such contact segments as located in a predefined pattern on the under surface of module 11. In comparing FIG. 2, each of the circuit lines 33 as located on the upper arm portion 39 of circuit 31 couples to a respective segment 19 (not shown in FIG. 2). Such coupling may occur through utilization of known connection techniques, e.g., soldering, and further description is not believed necessary. Alternatively, each circuit line 33 may include a contact pad 42 thereon (only one shown in phantom in FIG. 2), which in turn is coupled to a respective segment 19. Such pads, if utilized, would preferably be of similar construction to the various contacts 41 which also form part of each flexible circuit and are located, in the embodiment of FIG. 2, on the lower arm portion 43 of flexible circuit 31 and thus spaced from these other contacts. In one example of the invention, a total of about 52 first flexible circuits 31 may be utilized. To mate with each of these first flexible circuits, a plurality of second flexible circuits 45 are utilized. Each second flexible circuit 45, like first flexible circuits 31, is adapted for being electrically coupled to respective contact segments 19 (in this instance, however, on circuit board 13). Each second flexible circuit 45 is preferably of a substantially similar configuration to that shown for flexible circuit 31 in FIG. 2, and includes an array of contacts 41' formed in a predetermined pattern (e.g., linear as depicted in FIG. 2) on the arm portion thereof which, as shown in FIG. 1, is designed for extending within housing 23. These second flexible circuits may also include contacts thereon which align with and are connected to (e.g., through soldering) the respective contact segments 19, as is possible with flexible circuit 31. Such contact pads are not shown in FIGS. 1 and 3, but are understood to be of possibly a similar configuration as contacts 41 (and 42) in FIGS. 1 and 2. Understandably, a number of second flexible circuits 45 similar to that for the first flexible circuits 31 is used.

In the broader aspects of the invention, it is understood that only a singular first flexible circuit 31 and a corresponding singular second flexible circuit 45 may be utilized to accomplish the high density interconnections defined herein. To assure even greater capability for connector 10, it is preferred that additional such flexible circuits, in the paired arrangements depicted, be utilized.

As shown in FIG. 1, the first and second flexible circuits 31 and 45 extend within housing 23 from substantially opposing directions and align with each other in paired relationships such that the arrays of contacts 41 and 41' thereon are also aligned. That is, each contact 41 aligns with a respective contact 41'. This alignment for each paired combination occurs within a common chamber 47 defined by the internal walls of housing 23. As shown, such a common chamber is provided for each of these paired combinations. To permit entry of the first flexible circuits 31, the upper part 25 of housing 23 includes a plurality of elongated slots 49 within the side wall 51 immediately adjacent circuit member 11. Similarly, the bottom part 27 of housing 23 includes a plurality of elongated slots 53 therein each designed for accommodating a respective one of the second flexible circuits 45. Elongated slots 49 are also shown in FIG. 6 and are arranged in a substantially parallel pattern within upper part 25. It is understood that slots 53, not shown in FIG. 6, are of similar configuration and occupy a similar pattern below slots 41 and within lower part 27.

Alignment of the paired flexible circuits is further assured by securing one of each pair within housing 23. In one embodiment of the invention, such securement is attained by inserting the end portion of this circuit within a groove formed within the housing to accept same. In FIG. 1, the second flexible circuits 45 are each securedly retained within housing 23 using respective grooves 55, each groove 55 having the end portion 57 of each first circuit inserted therein. Securement may be attained through frictional insertion and/or the utilization of a suitable adhesive (the latter used if a more permanent securement is desired). The corresponding first flexible circuits 31 need not be fixedly secured, as shown in FIG. 1, but need only extend within housing 23 in the manner shown. This is particularly true if connector 10 and the respective circuit members 11 and 13 are to be oriented in the vertical configuration depicted in FIG. 1. Such orientation is not meant to limit the invention, in that connector 10 is capable of interconnecting circuit members of a different orientation, including those located substantially side-by-side on the same elevation.

Flexible circuits 31 and 45 extend within housing 23 to occupy the initial, non-contacting orientation shown in FIG. 1. As such, the respective arrays of contacts 41 and 41' are initially aligned relative to each other. As stated, such contacts may be in the form of substantially flat conductive (e.g., copper) pads. These may also include an overplate (e.g., nickel) and a precious metal (e.g., gold) thereon. Alternatively, such contacts 41 and 41' may be in the form of interdigitated dendritic members such as defined in the aforementioned application Ser. No. 07/415,435, filed Sept. 28, 1989. Such dendritic members, if utilized, may be comprised of palladium, platinum, rhodium, ruthenium, osmium or tungsten. The disclosure of Ser. No. 07/415,435 is thus incorporated herein by reference. Such a dendritic interconnection may be highly desired for several reasons, including to provide increased contact area, debris penetration and low, but highly reliable, contact force. Use of such interconnections also assures a wiping type engagement between contacts 41 and 41', such wiping considered highly desirable in the connector art, e.g., to remove contaminants such as dirt and dust which may form on and/or between the contacts during periods of non-engagement.

Figure 3:
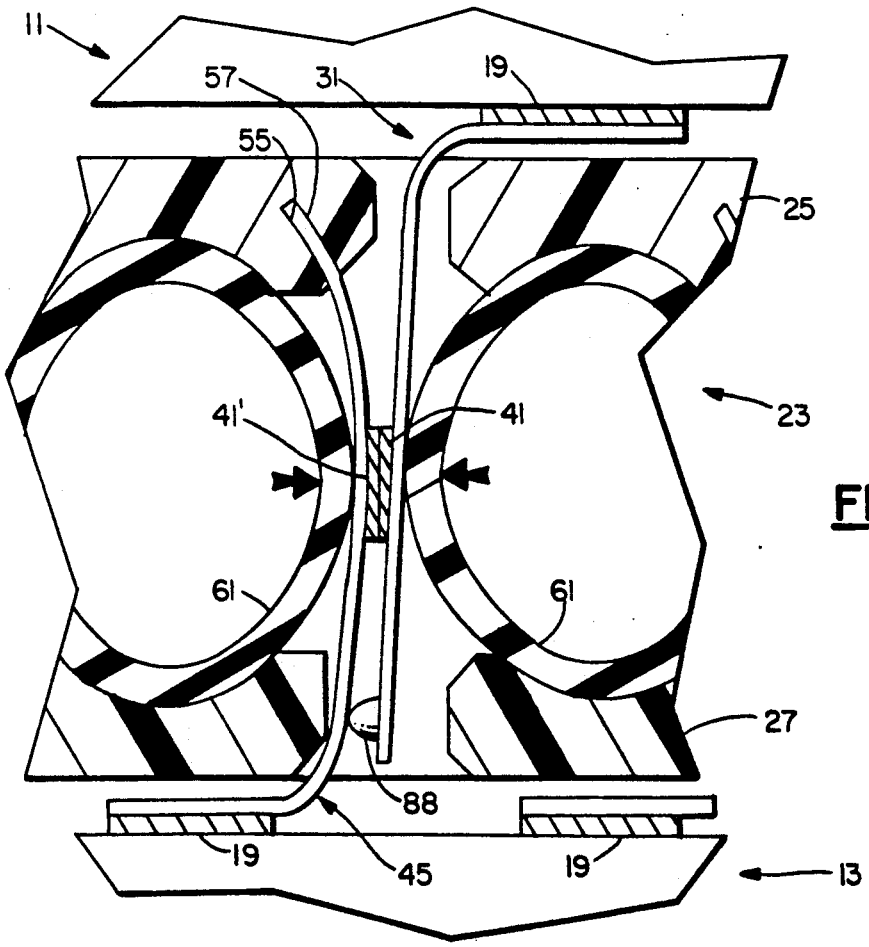
FIG. 3 is a much enlarged partial view, in section, of the connector of FIG. 1 in an actuated state.

With the extended first and second flexible circuits 31 and 45 initially positioned within housing 23 as shown in FIG. 1, connector 10 further includes means for engaging these circuits to cause the circuits to move toward each other such that effective connection will occur between contacts 41 and 41'. As shown in FIG. 1, this engagement is effected through utilization of expandable bladders 61 which are also located within housing 23 and, as shown in FIG. 6, are of elongated configuration and lie substantially parallel to each other therein. Each expandable bladder is located relative to a respective one of the flexible circuits so that, when actuated, it will expand to cause this circuit to move in a direction toward the other, facing flexible circuit. Thus, at least two such expandable bladders are used for each aligned pair of first and second flexible circuits. Two such bladders, as shown in FIG. 1, are located on opposite sides of each paired combination of circuits. Once actuated, as shown in FIG. 3, each expandable bladder expands sufficiently to engage the dielectric substrate portion of the adjacent flexible circuit to cause engagement between the arrays of contacts located thereon. Bladders 61 are shown in the fully expanded position in FIG. 3. Initially, each bladder 61 is preferably of substantially oval configuration to occupy similarly configured openings defined within housing 25 (by the two parts 25 and 27). Alternatively, each bladder may possess a cross-sectional configuration (e.g., rectangular) to assure more compact spacing within housing 23. Each expandable bladder 61 is preferably comprised of polyurethane or silicon rubber and preferably possesses a side wall thickness within the range of about 0.002 to about 0.020 inch. As stated, bladders 61 preferably lie substantially parallel to one another within the box-like, rectangular housing 23. As such, end portions thereof lie substantially contiguous to the respective end portions of housing 25, as best seen in FIG. 6. That is, each bladder 61 may comprise a singular, elongated member extending substantially the entire length (dimension "S1") of housing 23. In an alternative embodiment, it is possible to connect various end portions of these bladders to instead provide such a member of a serpentine or other configuration. An example of such an arrangement is shown in FIG. 6 and represented by the numeral 61'. Should such a bladder (61') be utilized, the initial end 63 will preferably have access to (and perhaps extend from) the one end portion of housing 23 while the remaining end of this bladder (65) will extend from or lie contiguous to the opposing end of the housing. The above configurations for bladders 61 are not meant to limit the invention, and it is understood that alternative configurations may be readily employed. The embodiments depicted in FIG. 6 are preferred, however, such that housing 23 and the bladders 61 (and/or 61') contained therein may be operatively connected to a pair of manifolds 71 and 73 (shown in phantom) so as to facilitate receipt and discharge of the desired fluid designed for actuating said bladders. In the embodiment of FIG. 6, manifold 71 serves as the inlet manifold designed to receive fluid therein for distribution to respective ends of bladders 61 (and/or 61') such that this fluid will pass therethrough and exit through common exit manifold 73. The fluid direction is also represented by the arrows "I" (for incoming) and "O" (for outgoing) in FIG. 6.

By the term liquid as used herein is meant to include both liquids and gasses. One example of a liquid may be a miscable, high density, high molecular weight, colorless perfluorinated liquid currently available under the trade name Fluorinert (a trademark of the Minnesota Mining & Manufacturing Company). This liquid, one example referred to as FC-77, may be utilized and preferred because of its non-contaminating nature, in addition to the fact that it is substantially non-compressible and thus capable of being loaded to relatively high pressures (e.g., 2500–5000 pounds per square inch). If such a liquid is utilized, suitable valving and/or metering units (not shown) would preferably be employed as part of the fluid supply means to connector 10. Significantly, the fluid pressure means of the invention is also capable of providing cooling of bladders 61 (and thus of flexible circuits 31 and 45 and the arrays of contacts located thereon) if desired. Such cooling may be necessary in the event of relatively high contact temperatures (e.g., during power or the like connections). In one example, a cooling fluid such as purified water at a pressure within the range of about 30 to about 50 pounds per square inch may be supplied to the intake manifold 71 for distribution through connector 10. Such a fluid would then preferably be circulated, using a closed loop system, through suitable cooling means, e.g., a heat exchanger, and returned to manifold 71. The above pressures are considered acceptable to accomplish sound, effective connections between paired arrays of contacts 41 and 41' when using components having materials and dimensions as recited above.

To prevent possible abrasion between each bladder 61 and the respective flexible circuit being engaged thereby, a coating (not shown) of suitable polymer (e.g., polyimide or polytetrafluoroethylene) may be applied to the rear surface (that facing the respective engaging bladder) of the flexible circuit's dielectric substrate. Such an interim coating will serve to substantially prevent abrasion during such periods of engagement utilizing the pressures defined herein.

To prevent engagement between contacts 41 and 41' prior to connector actuation, each first flexible circuit 31 includes at least one (and preferably several, as shown in FIG. 2) compressible elastomeric, electrically insulative elements 88 located thereon and along a lower part of the circuit. Each element 88 protrudes sufficiently from circuit 31 to engage the facing surface of circuit 45 and thereby prevent contacts 41 and 41' from engaging. Upon actuation of connector 10 (as shown in FIG. 3), each element 88 compresses sufficiently to enable the contacts to mate. The preferred material for each element 88 is silicone rubber, each being attached to circuit 31 by a suitable adhesive, several of which are known in the art.

To assure alignment between the interim housing 25 and circuit members 11 and 13, connector 10 includes such means for providing this alignment. In one example of the invention, this alignment may be accomplished using at least two elongated pins 81 located at spaced-apart positions and passing through the two-part housing 23 such that extending end portions thereof are positioned within respective openings 83 provided within circuit members 11 and 13. Although a singular elongated pin is shown as passing through the entirety of housing 23 at each designated location in FIG. 1, it is understood that, alternatively, other possible pin at aperture combinations are possible. For example, it is possible to utilize two opposed and aligned pins projecting from each part of housing 23 at each such location, each pin in turn designed for being positioned within a corresponding aperture within one of the circuit members. Other combinations are of course readily possible for use with the present invention.

Figure 4:
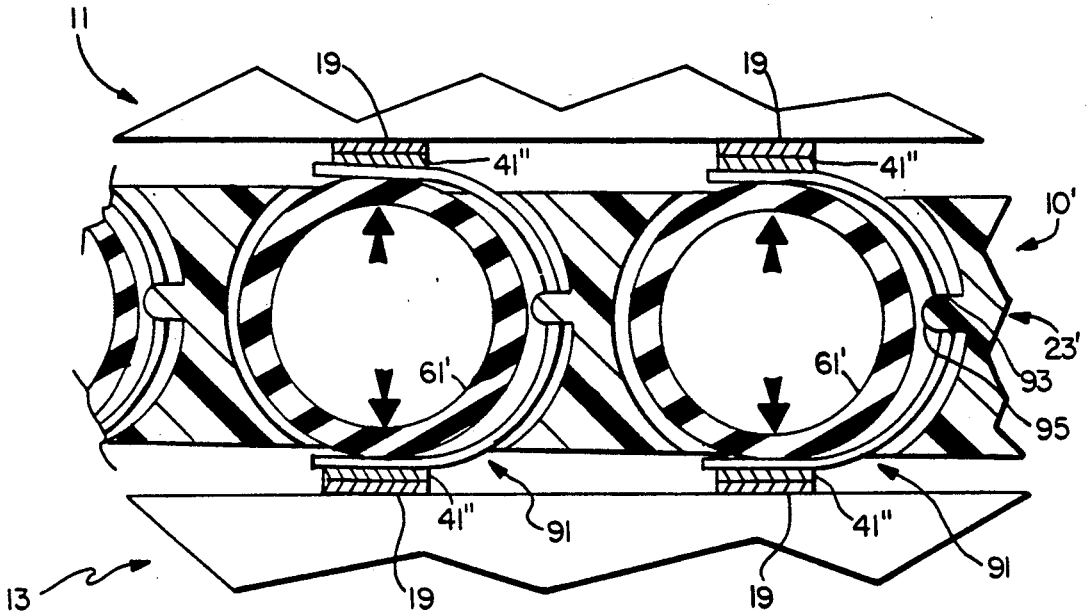
FIG. 4 is a partial, elevational view, partly in section, of an electrical connector in accordance with another embodiment of the invention.
Figure 5:
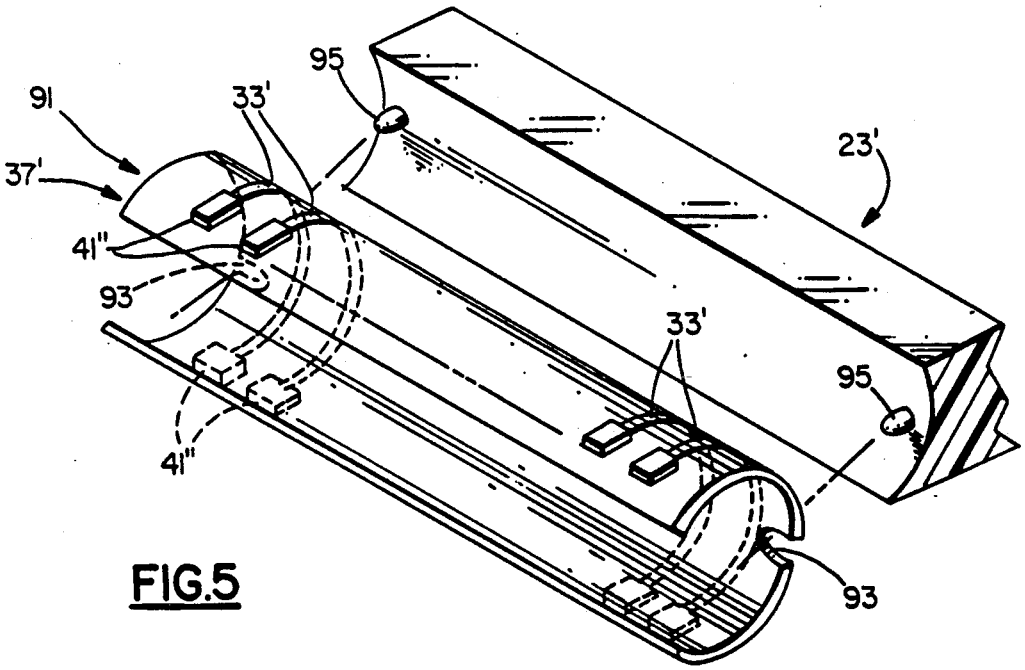
FIG. 5 is a perspective view of a flexible circuit and one portion of a housing which may be used in the embodiment shown in FIG. 4.

In FIG. 4, there is shown a connector 10' in accordance with another embodiment of the invention. Connector 10', like connector 10, is designed for interconnecting two circuit members (11, 13) to provide high density connections of the type defined above. Unlike connector 10, however, connector 10' is able to achieve such interconnections using relatively fewer components. As shown, connector 10' includes a housing 23' which is preferably of similar material as that for housing 23 and also of similar external configuration. Housing 23' may also be of two-part construction to facilitate assembly and/or repair thereof. To provide interconnection between arrays of contact segments 19 on one circuit member with a corresponding array of contact segments 19 on the other circuit member (13), connector 10' utilizes a singular flexible circuit 91 for each respective pair of such arrays being connected. As shown in FIG. 4, a singular flexible circuit 91, of curvilinear configuration, is used to interconnect substantially parallel opposed arrays 19. Flexible circuit 91, as shown with greater particularity in FIG. 5, preferably includes a dielectric substrate 37' similar to that of substrate 31 in FIG. 2, and further includes circuitry 33' thereon. Circuitry 33', in the form of conductive lines, serves to interconnect opposing arrays of contacts 41''. Contacts 41'', preferably arranged in linear rows as shown in FIG. 5, align with and engage similar numbers of contact segments 19 of circuit members 11 and 13, respectively. Each contact 41'' is preferably of substantially flat, rectangular configuration as depicted in FIG. 5 and preferably of a highly conductive material (e.g., copper). Each such contact also preferably includes the aforementioned overplate (e.g., nickel) and precious metal (e.g., gold) thereon. Alternatively, the aforedescribed dendritic, interdigitated members for each contact 41'' may be utilized. Effective engagement between respective arrays of contacts 41'' and segments 19 is accomplished by expansion of expandable bladders 61' which, as shown, are located within housing 23'. Unlike bladders 61 in connector 10, however, bladders 61' are each preferably of substantially circular cross-sectional configuration. Further, these bladders are preferably elongated and arranged within housing 23' in a substantially parallel manner similar to that of bladders 61. Similar means, including the fluids defined above, may be utilized to actuate each expandable bladder 61'. Upon actuation, the opposing sides thereof expand in the directions indicated to compress contacts 41'' against the corresponding, respective segments 19. Like bladders 61, each bladder 61' thus exerts a force against the respective arrays of contacts on the respective flexible circuit to effect electrical connections as defined herein.

Housing 23' of connector 10', like housing 23, also includes opposing slots therein through which the extending end portions of the curvilinear flexible circuit may extend in the manner shown in FIG. 4. If housing 23' is of two-part construction, the upper part in the orientation depicted in FIG. 4 would include these slots along the upper surface thereof while the lower portion of the housing would include slots in the respective outer surface thereof.

Housing 23' also preferably includes means for aligning each flexible circuit 91 within the housing such that initial alignment between the respective contacts and contact segments is assured. As shown in FIG. 5, such alignment is possible by providing at least one (and preferably two) apertures 93 within the flexible circuit's dielectric substrate such that projecting portions 95 of each portion of housing 23' designed to accommodate a respective one of bladders 61 may be inserted therein to engage the side surfaces of the flexible circuit to thus prevent both rotational and lateral movement thereof. Alternative means of alignment are also possible for use in connector 10' and the aforementioned projections and corresponding apertures are thus not meant to limit the scope of the invention. Connector 10' may further include cooling means and various components associated therewith (e.g., inlet and outlet manifolds) as used in connector 10.

Thus there has been shown and described an electrical connector for electrically interconnecting a pair of electrical circuit members such as circuit modules and printed circuit boards. The connector as defined herein thus serves as an interposer which is capable of providing high density connections as well as those of lesser density (e.g., power applications). The invention as defined is of relatively simple construction, thereby facilitating assembly and/or repair thereof, as well as selective testing of the internal components thereof. Additionally, the invention provides added features such as cooling in the event that such cooling is considered necessary. Most significantly, the connector as defined herein utilizes fluid pressure actuation and the several distinct advantages thereof, particularly uniformity of pressure, to assure sound, effective connections where desired. While the invention has been shown to provide connection between substantially linear arrays of various contact segments, the invention is not to be limited thereto. Understandably, it is also obvious from the teachings herein that alternative arrays of segments (and associated contacts) may be connected. Still further, unlike mechanical type connector systems where the flatness and parallel condition of contact surfaces must be held to extremely tight tolerances, the present invention may accommodate much greater out-of-flat conditions, while still assuring uniform force of the invention's contacts thereagainst.

While there have been shown and described what are at present considered the preferred embodiments of the invention, it will obvious to those skilled in the art that various changes and modifications may be made therein without departing from the scope of the invention as defined by the appended claims.

What is claimed is:

1. An electrical connector for electrically interconnecting first and second electrical circuit members, said connector comprising:

a housing adapted for being positioned substantially between said first and second electrical circuit members;

first and second flexible circuits, each including an array of contacts thereon and adapted for being electrically coupled to said first and second electrical circuit members, respectively, said flexible circuits adapted for extending within said housing from substantially opposing directions such that said arrays of said contacts are aligned relative to each other in a facing, spaced-apart manner;

first and second expandable bladders located substantially within said housing relative to said first and second flexible circuits, respectively, said first and second expandable bladders exerting force against said first and second flexible circuits, respectively, to cause said arrays of contacts to move toward each other and engage in a predetermined manner; and fluid pressure means operatively coupled to said expandable bladders for expanding said bladders to effect said engagement between said arrays of said contacts.

2. The electrical connector according to claim 1 wherein said expandable bladders are comprised of a material selected from the group consisting of rubber and polyurethane.

3. The electrical connector according to claim 1 wherein said first circuit member is a circuit module and said second circuit member is a printed circuit board.

4. The electrical connector according to claim 1 wherein said housing includes means therein for securedly retaining one of said flexible circuits therein.

5. The electrical connector according to claim 4 wherein said means for securedly retaining said flexible circuit comprises a groove, an end portion of said flexible circuit secured within said groove.

6. The electrical connector according to claim 1 wherein said expandable bladders are of elongated shape and are located within said housing in a substantially parallel orientation.

7. The electrical connector according to claim 6 wherein said expandable bladders are of a substantially oval cross-sectional configuration.

8. The electrical connector according to claim 1 further including means for aligning said housing and said first and second electrical circuit members relative to each other.

9. The electrical connector according to claim 8 wherein said means for aligning comprises at least two elongated pins passing through said housing at spaced-apart locations therein, and adapted for being positioned within said first and second electrical circuit members.

10. The electrical connector according to claim 1 wherein said housing includes a common chamber therein, said aligned arrays of said contacts of said first and second flexible circuits extending within said housing being located within said common chamber.

11. The electrical connector according to claim 10 wherein said housing includes a pair of opposing side walls each including an elongated slot therein, each of said flexible circuits passing through a respective one of said elongated slots.

12. The electrical connector according to claim 11 wherein said housing comprises at least two parts, a first of said parts including one of said side walls therein and a second of said parts including a second of said side walls therein.

13. The electrical connector according to claim 1 wherein said fluid pressure means further provides cooling fluid to said expandable bladders to provide cooling of said aligned arrays of contacts during said engagement thereof.

14. The electrical connector according to claim 13 wherein said cooling fluid is water.

15. The electrical connector according to claim 13 wherein said cooling fluid is provided said expandable bladders at a pressure within the range of from about 30 to about 50 pounds per square inch.

16. The electrical connector according to claim 13 further including first and second manifolds, both of said manifolds operatively connected to said housing and having access to said expandable bladders, said first manifold adapted for providing fluid to said bladders and said second manifold adapted for having said fluid from said bladders pass therethrough to thereby exit said electrical connector.

17. An electrical connector for electrically interconnecting first and second separate electrical circuit members, said connector comprising:

a housing adapted for being positioned substantially between said first and second electrical circuit members;

at least one flexible circuit located substantially within said housing and including first and second separate, spaced-apart arrays of contacts thereon, said first array adapted for being electrically coupled to said first electrical circuit member and said second array adapted for being electrically coupled to said second electrical circuit member;

at least one expandable bladder located substantially within said housing relative to said first and second arrays of contacts, said bladder exerting force against said first and second arrays of contacts of said flexible circuit to cause said arrays to move toward said respective first and second electrical circuit members and become electrically coupled thereto; and fluid pressure means operatively coupled to said expandable bladder for expanding said bladder to effect said electrical coupling between said arrays of contacts and said first and second electrical circuit members.

18. The electrical connector according to claim 17 wherein said expandable bladder is comprised of a material selected from the group consisting of rubber and polyurethane.

19. The electrical connector according to claim 17 wherein said first circuit member is a circuit module and said second circuit member is a printed circuit board.

20. The electrical connector according to claim 17 wherein said housing includes a pair of opposing side walls each including an elongated slot therein and said flexible circuit includes opposing end portions each having a respective one of said arrays of contacts located thereon, each of said end portions of said flexible circuit having one of said arrays of contacts thereon extending through a respective one of said elongated slots.

21. The electrical connector according to claim 20 wherein said housing comprises at least two parts, a first of said parts including one of said side walls therein and a second of said parts including a second of said side walls therein.

22. The electrical connector according to claim 17 further including a plurality of said expandable bladders, said expandable bladders being of elongated shape and located within said housing in a substantially parallel orientation.

23. The electrical connector according to claim 22 wherein said expandable bladders are of a substantially circular cross-sectional configuration.

24. The electrical connector according to claim 17 further including means for aligning said housing and said first and second electrical circuit members relative to each other.

25. The electrical connector according to claim 24 wherein said means for aligning comprises at least two elongated pins passing through said housing at spaced-apart locations therein and adapted for being positioned within said first and second electrical circuit members.

26. The electrical connector according to claim 17 further including means to align said flexible circuit within said housing such that said first and second arrays of said contacts are aligned relative to said first and second electrical circuit members, respectively.

27. The electrical connector according to claim 26 wherein said means for aligning said flexible circuit comprises at least one projection located within said housing and at least one aperture within said flexible circuit, said projection extending within said aperture.

28. The electrical connector according to claim 27 wherein said means for aligning comprises two of said projections located in a spaced-apart manner within said housing, said flexible circuit including two of said apertures located therein in a spaced-apart manner and adapted for having a respective one of said projections positioned therein.

29. The electrical connector according to claim 17 wherein said fluid pressure means further provides cooling fluid to said expandable bladders to provide cooling of said aligned arrays of contacts during said engagement thereof.

30. The electrical connector according to claim 29 wherein said cooling fluid is water.

31. The electrical connector according to claim 29 wherein said cooling fluid is provided said expandable bladders at a pressure within the range of from about 30 to about 50 pounds per square inch.

32. The electrical connector according to claim 29 further including first and second manifolds both of said manifolds operatively connected to said housing and having access to said expandable bladder, said first manifold adapted for providing fluid to said bladder and said second manifold adapted for having said fluid from said bladder pass therethrough to thereby exit said electrical connector.

* * * * *